US012618118B2

(12) United States Patent
Xiao et al.

(10) Patent No.: US 12,618,118 B2
(45) Date of Patent: May 5, 2026

(54) HIGH EFFICIENCY PROCESSING METHOD AND PLANT FOR MULTIPHASE STEEL SLAG

(71) Applicant: BAOSHAN IRON & STEEL CO., LTD., Shanghai (CN)

(72) Inventors: Yongli Xiao, Shanghai (CN); Yongqian Li, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 740 days.

(21) Appl. No.: 17/922,663

(22) PCT Filed: Mar. 29, 2021

(86) PCT No.: PCT/CN2021/083672
§ 371 (c)(1),
(2) Date: Nov. 1, 2022

(87) PCT Pub. No.: WO2021/223543
PCT Pub. Date: Nov. 11, 2021

(65) Prior Publication Data

US 2023/0265533 A1 Aug. 24, 2023

(30) Foreign Application Priority Data

May 6, 2020 (CN) ..... 202010373411.0

(51) Int. Cl.
*C21B 3/08* (2006.01)

(52) U.S. Cl.
CPC ..... *C21B 3/08* (2013.01); *C21B 2400/024* (2018.08); *C21B 2400/056* (2018.08); *C21B 2400/066* (2018.08)

(58) Field of Classification Search
CPC ..... C21B 3/08; C21B 2400/024; C21B 2400/056; C21B 2400/066;
(Continued)

(56) References Cited

U.S. PATENT DOCUMENTS 9,084,999 B2 * 7/2015 Xiao ..... B02C 17/04
11,519,043 B2 12/2022 Li et al.

FOREIGN PATENT DOCUMENTS

CN 1858262 A 11/2006
CN 101875984 A 11/2010
(Continued)

OTHER PUBLICATIONS

CN107557505A English language translation (Year: 2019).*
(Continued)

*Primary Examiner* — Jessee R Roe
*Assistant Examiner* — Michael Aboagye
(74) *Attorney, Agent, or Firm* — Lei Fang, Esq.; Smith Tempel Blaha LLC

(57) ABSTRACT

The disclosure provides a high efficiency processing method and plant for multiphase steel slag. The plant comprises a steel slag feeding equipment and a rotary drum for processing steel slag. The feeding equipment comprises a feeding chute; the processing plant further comprises a storage bin is provided between the feeding chute and the rotary drum, the storage bin is in a shape of barrel, with one end forming a rotatable fit with a lower opening end of the chute with a funnel, the other end being connected with a processing chamber of the rotary drum and coaxial with the rotary drum. With the storage bin that is inclined and provided between the front of the rotary drum and the feeding chute, working as buffer transition section, the safe rotary drum processing for each type of steel slag can be achieved without using the slag removal equipment.

9 Claims, 5 Drawing Sheets

(58) Field of Classification Search
CPC . C21B 2400/032; C21B 2400/06; C21B 3/06; C21B 3/10; Y02P 10/20; Y02W 30/50
USPC ..... 266/201, 202, 44, 227; 75/672, 640, 655
See application file for complete search history.

(56) References Cited

FOREIGN PATENT DOCUMENTS

| | | | | | |
|---|---|---|---|---|---|
| CN | 101760572 | B | | 6/2011 | |
| CN | 103484578 | | * | 1/2014 | ..... Y02W 30/50 |
| CN | 103849698 | A | | 6/2014 | |
| CN | 104894309 | A | | 9/2015 | |
| CN | 107557505 | A | | 1/2018 | |
| CN | 108165686 | A | | 6/2018 | |
| CN | 108220510 | A | | 6/2018 | |
| EP | 3480323 | A1 | | 5/2019 | |
| JP | S5935608 | A | | 2/1984 | |
| JP | S6026604 | A | | 2/1985 | |
| JP | S6452637 | A | | 2/1989 | |
| JP | 2019520481 | A | | 7/2019 | |
| KR | 20200015598 | A | | 2/2020 | |
| RU | 2530914 | C1 | | 10/2014 | |

OTHER PUBLICATIONS

CN103484578,Feeding System For Roller Method Metallurgical Slag Processing Device, Xiao et al., Jan. 1, 2014 (Year: 2014).*
Examination Report from India Patent Office dated Jan. 6, 2023.
EPO Extended Search Report dated Aug. 9, 2023.
Russian Search Report dated Jun. 30, 2023.
International Search Report for PCT/CN2021/083672 dated Jun. 29, 2021.
International Written Opinion for PCT/CN2021/083672 dated Jun. 29, 2021.
JP Office Action dated Oct. 13, 2023 for JP App No. 2022-565698.

* cited by examiner

HIGH EFFICIENCY PROCESSING METHOD AND PLANT FOR MULTIPHASE STEEL SLAG

CROSS-REFERENCE TO RELATED APPLICATIONS

This application is a 371 U.S. National Phase of PCT International Application No. PCT/CN2021/083672 filed on Mar. 29, 2021, which claims benefit and priority to Chinese patent application No. CN202010373411.0 filed on May 6, 2020, the contents of each of the above listed applications are incorporated by reference herein in their entiries.

TECHNICAL FIELD

The disclosure relates to a metallurgical slag processing method and plant, in particular to a high efficiency processing method and plant for multiphase high temperature steel slag by a rotary drum processing.

BACKGROUND

Steel slag is one of the bulk by-products produced during the steel production process, accounting for about 10-30% of crude steel production; steel slag is mainly composed of calcium, magnesium, silicon, aluminum, iron and other metal oxides, phosphorus, sulfur non-metallic oxides and the complex mixture composed of various polymers with high melting point, and is also doped with 1-10% metallic iron with different particle sizes; the temperature of the steel slag just discharged from the furnace is about 1500° C., most of the steel slag is at a molten state with fluidity, however with the decrease of the temperature, the viscosity of the steel slag increases rapidly, releasing a lot of heat. Due to the difference in the steelmaking process of each steel plant, the composition and temperature of the steel slag produced during the steelmaking process are different: some of the high temperature steel slag has high fluidity, which can be poured like water; some of the slag has poor fluidity, which is difficult to be poured from the slag tank (the container for holding and conveying the high temperature steel slag, also known as slag bag), and can only be removed from the slag tank with the assistant of external mechanical force or by inverting the slag tank; in order to extend the service life of the slag tank and prevent the high temperature steel slag from scouring the bottom of the slag tank when the slag is poured therein, it is necessary to put some cold slag on the bottom of the empty slag tank when receiving slag from the converter furnace, so that when pouring the high temperature steel slag, these cold slag will be mixed and molten with the high temperature steel slag, forming into large slag lumps together with the steel slag on the inner wall of the slag tank, which are several tons or more than ten tons, accounting for about one-fourth to one-half of the total slag amount, this part of slag is also called the slag at the bottom of the tank. The complexity of the composition and the diversity of morphology of steel slag bring great difficulties to the processing and subsequent utilization of steel slag.

The most common steel slag processing techniques are hot pouring and post-processing, where the high temperature steel slag is poured into the slag processing place for natural cooling, and then the cooled steel slag is subjected to crushing, magnetic separating and classification screening, the cold steel recovered is returned to the production process for utilization, and the tailings after separation are reused or sold socially according to particle size and performance. The steel slag can be attributed to silicate material, which has poor thermal conductivity and extremely low natural cooling rate. In order to improve the cooling processing efficiency of steel slag and reduce the area of the cooling processing place, mechanical turning over, spraying cooling water and other actions are often taken in the slag processing workshop, resulting in the diffusion of dust and waste steam and harsh working environment where the dust in the surrounding environment exceeds the standard seriously and there is a risk of explosion if not careful. Nowadays the environmental protection requirement is more strict, the short-process, fast, safe and environmentally friendly high temperature steel slag processing technique has become the focus of steel enterprises to explore urgently. The steel slag processing technique by the drum method developed by an steel enterprise rises in response to such background, which is an airtight, fast and resourceful novel technique for steel slag hot processing, achieving the function of dynamical, continuously and rapid cooling of the high temperature metallurgical slag and crushing the slag into granular product slag with a particle diameter of less than 50 mm in the airtight equipment, where the exhaust gas generated during the process is collected by the gas duct and discharged through the chimney up to the standard after the purifying processing, so the current situation of disorderly discharge in other processing technique is completely changed, and the recycle of sewage and zero discharge is achieved. The process not only is a short process with a low cost, but also is easy to operate, safe and reliable, the steel slag after processing can be used directly as a resource, therefore the technique has been recognized by the industry as soon as it came out, and the process technique and the level of equipment has been improved continuously and developed rapidly with the implementation of industrialization and commercialization. However, so far, due to the limitations of technique development, the conventional rotary drum process can only process the steel slag with high fluidity on a single equipment, even with the assistance of the slag tank tilting mechanism and the slag scraper, only part of the viscous solid steel slag can be scraped into the rotary drum quantitatively, which has a low efficiency and a long processing period. The large-sized slag at the bottom of the tank often needs to be poured onto the ground or flowed backwards, and the efficiency of feeding slag with the slag scraper is low.

Chinese Patent CN200420107540.1 and CN200810207918.8 discloses a 'tilting type drum method metallurgical dreg processing device' and a 'high-temperature slag handling technology by tilting roller process and device', mainly relates to the body structure of the rotary drum and the steel slag with a certain fluidity can be cooled rapidly by the multi-media in sequence and crushed in the rotary drum and transported outside the equipment, this type of rotary drum cannot deal with the solid slag without fluidity, especially the large pieces of slag on the bottom of the tank.

CN201210159321.7 discloses a 'steel slag full drum treatment process and a device for cleaning slag', the sticky slag on the wall of the slag tank or the bottom of the slag tank is loosened by the knocking action of the slag loosening mechanism, and then the small pieces of steel slag after being loosened are scraped out by the slag removal mechanism. This method is not only inefficient for processing the highly viscous slag or the slag on the bottom of the tank, but also difficult to clean up the highly viscous slag sticked on the wall of the slag tank.

CN201510365716.6 discloses a full-process processing system and technique for steel slag by a drum method. The system mainly comprises: tipping device and slag removal device for auxiliary feeding, drum for steel slag core processing, finished product conveying device, vibration separating device, bucket elevating device, online magnetic separation device, material storage device, dust removal device, water system device and electrical control device, which can be used for reducing the occupancy rate of traffic; performing online sorting and preliminary magnetic separation of steel slag after drum processing; storing materials in high-level silo to avoid environmental pollution caused by secondary or even multiple loading and unloading of finished product slag.

The above technical solution needs to use the slag scraper, resulting in low efficiency. At the meantime, a large amount of high temperature steel slag pouring into the rotary drum processing chamber and on the steel balls during the tilting process leads to a large amount of high temperature steel slag to accumulate instantaneously, which is likely to cause explosion and cannot be operated continuously.

The ideal steel slag processing technique and equipment by the rotary drum method should not only be operated in a reliable, safe and environmentally friendly way, but also have the characteristics of low investment and operation costs. Such processing technique will be related to the continuous processing technique of high temperature steel slag, covering the full amount of steel slag in the same rotary drum (cannot only processing the high temperature steel slag with high fluidity but also processing the highly viscous slag sticked on the wall of the tank and the solid slag without fluidity, especially the large pieces of slag on the bottom of the tank safely), continuity, and also satisfy the requirement of automatic operation, reducing the safety hazards and errors caused by manual operation.

SUMMARY

To overcome the above problems, the objective of the disclosure is to provide a high efficiency processing method and plant for multiphase steel slag, the processing method and processing plant can achieve the goal of full quantified, continuous, high-efficiency and automated steel slag processing, which not only can process the high temperature steel slag with high fluidity but also can process the solid steel slag without fluidity, especially the large pieces of steel slag at the bottom of the tank, and also satisfy the requirement of automatic operation, reducing the potential safety hazards and errors caused by manual operation.

According to the disclosure, with the aid of the slag tank tilting mechanism, the safe and environmental friendly rotary drum processing technique for each type of steel slag can be achieved by the storage bin that is inclined and provided between the front of the rotary drum and the feeding chute, working as buffer transition section, without using the slag removal equipment, and the processing efficient is more than double that of the conventional rotary drum. Since the continuous operation of the rotary drum is achieved, the temperature fluctuation of the rotary drum is small, the operating life is long and the maintenance cost is low. At the meantime, since the mechanical cold steel cleaning equipment is provided, the downtime of the rotary drum is further reduced and the operation rate of processing steel slag by the rotary drum method is improved.

To achieve the above technical purpose, the following technical solution is adopted by the present disclosure:

The high efficiency processing method for multiphase steel slag, where the steel slag is multiphase high temperature steel slag, comprising the steel slag with high fluidity and highly viscous slag with poor fluidity or solid steel slag, the method comprises the following steps:

steel slag feeding—steel slag processing by rotary drum method—exhaust emission and purification—cooling water circulation and cold steel cleaning, wherein 1. steel slag feeding the slag tank with multiphase high temperature steel slag is held tightly by the tilting mechanism and moved to the slag feeding position, the slag tank is tilted so that the high temperature steel slag with high fluidity in the slag tank can be poured through a feeding chute controllably at a set tilting speed, and into the storage bin that is placed at an inclined angle between the front part of the rotary drum and the feeding chute and rotates continuously with the rotary drum, the high temperature steel slag is cooled rapidly and solidified at the inner wall of the storage bin, separated from the inner wall of the storage bin with the rotation of the storage bin due to the gravity force, and slides controllably along the inclined direction of the storage bin and moves into the rotating rotary drum and is processed by a rotary drum processing;

2. turning the tank when the highly viscous slag or solid slag remained in the slag tank cannot flow out because of its low fluidity, the slag tank is tilted continuous so that all the steel slag in the tank are poured into the funnel of the feeding chute provided at the inclined angle, the highly viscous slag or solid slag slides into the feeding chute and the rotating storage bin through the funnel of the feeding chute due to the gravity force, and then slides slowly into the rotary drum with the rotation of the rotary drum and the storage bin due to the gravity force and the angle of inclination of the storage bin, and is processed by a rotary drum processing, where the speed of the highly viscous slag or solid slag sliding into the rotary drum is determined by the rotary drum;

3. restoring the tilting equipment when turning the tank is completed, the tilting equipment is restored, continue with the next slag tank, where the rotary drum is not stopped and at a continuous operating state during the process;

4. cleaning slag by the slag cleaning machine when the steel slag is piled up or sticked on the feeding chute, the steel slag is cleaned mechanically by the mechanical arm of the slag cleaning machine provided above the chute to keep the feeding chute clear;

5. cleaning steel by the slag cleaning machine when there are many large pieces of cold steel accumulated in the rotary drum, the machine will be stopped for a short time, the feeding chute with the feeding funnel is removed, and the slag cleaning machine is turned on, the large pieces of cold steel are removed rapidly from the rotary drum through the storage bin by operating the mechanical arm of the slag cleaning machine and the electro magnet at its end.

In the past, the storage bin is provided at the rear of the rotary drum, but the storage bin is used for collecting the steel slag after steel ball cooling and crushing and is discharged to the discharging chute by the plate. In the present disclosure, the storage bin is provided at the front of the steel ball processing chamber of the rotary drum, which is mainly used for receiving the large amount of steel slag pouring in when the slag tank is tilted, so as to avoid the explosion when the high temperature steel slag is accumulated on the processing chamber of the rotary drum and the steel balls, that is, the storage bin in the present disclosure is for safety and buffer.

Different from the past, according to the present disclosure, the steel slag is not scraped into the storage bin from the funnel but slides therein due to the gravitational force.

The high efficiency processing method for multiphase steel slag according to the present disclosure, wherein the angle of inclination of the storage bin to the horizontal plane is 0-25°, preferably 8-12°, and the storage bin is fixed with the rotary drum, the volume of the storage bin is 2-3 times the volume of the slag tank for accommodating all the slag in the slag tank, preventing the high temperature steel slag from accumulating on the processing chamber and the steel balls which will cause explosion. The steel slag in the storage bin flows into the rotary drum slowly with the rotation of the rotary drum, contacting with the steel balls slowly and being taken away by the steel balls and then cooled and crushed.

Since the angle of inclination of the storage bin is generally about 10°, so the steel slag in the storage bin slides slowly into the rotary drum, contacts with the steel balls slowly and is taken away by the steel balls and then cooled and crushed.

According to the present disclosure, the storage bin is in a cylindrical or conical shape, one end has the size matching with the size of the lower opening end of the chute with the funnel, forming a loose mechanical sealing, and the other end is fixed with the processing chamber flange of the rotary drum and coaxial with the rotary drum. The angle of inclination is 0-25°, preferably 8-12°, for conveying the high temperature steel slag from the funnel into the processing chamber of the rotary drum with the rotation of the rotary drum, the axis of the rotary drum has an angle of inclination relative to the horizontal plane.

Additionally, according to the present disclosure, the outer wall of the storage bin is provided with the grid-shaped reinforcing plate, the outside of the reinforcing plate is provided with the annular cooling spray tubes along the circumference, the spray tubes are provided evenly along the axis of the storage bin, the outer cover is provided outside the cooling tubes, the outer cover is fixed with the ground and discharges the spraying water collected from the cooling tube, the cooling tube is fixed on the cover.

The high efficiency processing method for multiphase steel slag according to the present disclosure, wherein the slag discharging area of an outer cylinder of the rotary drum is provided with the water collecting rooms with a type of waterwheel, ensuring that there is no accumulation of water during processing, the rooms are provided evenly along the circumference of the outer cylinder, the angle of the partition plate between the rooms matches with the opening angle of the slag receiving funnel.

According to the present disclosure, the steel cleaning machine is provided with the swinging, walking and telescopic mechanisms of the mechanical arm, the end of the mechanical arm is provided with the electromagnet.

The angle of inclination of the storage bin to the horizontal plane is 0-25°, preferably 8-12°, and the storage bin is fixed with the rotary drum, the volume of the storage bin is 2-3 times the volume of the slag tank for accommodating all the slag in the slag tank, preventing the high temperature steel slag from accumulating on the processing chamber and the steel balls which will cause explosion. The steel slag in the storage bin flows into the rotary drum slowly with the rotation of the rotary drum, contacting with the steel balls slowly and being taken away by the steel balls and then cooled and crushed.

The high efficiency processing method for multiphase steel slag according to the present disclosure, wherein the inner wall of the storage bin is water cooling wall, the water cooling wall is used for cooling and solidifying the molten slag, and due to the gravity and rotation, the large pieces of slag after cooling are separated from the inner wall of the storage bin, the storage bin is in a cylindrical or conical shape, one end forms a clearance fit with the lower opening end of the chute with the funnel, the other end is connected with the processing chamber of the rotary drum and coaxial with the rotary drum. The outer wall of the storage bin is provided with the reinforcing plate, the outside of the reinforcing plate is provided with the annular cooling spray tubes along the circumference, the spray tubes are provided evenly along the axis of the storage bin, the outer cover is provided outside the cooling tubes, the outer cover is fixed with the ground and discharges the spraying water collected from the cooling tube, the cooling tube is fixed on the cover.

Preferably, the specific structure of the water-cooling wall of the storage bin inner wall is the annular cooling spray tubes provided along the circumference of the storage bin outer wall, and the spray tubes are provided evenly along the axis of the storage bin.

The high efficiency processing method for multiphase steel slag according to the present disclosure, wherein the feeding chute is provided on the steel structure platform, the size and shape of the upper edge matches with the size of the slag tank mouth, the lower opening end forms a clearance fit with the opening end of the storage bin.

The high efficiency processing method for multiphase steel slag according to the present disclosure, wherein for the convenience of replacement and maintenance, the upper part and lower part of the funnel are detachably connected, the form of connection can be a flange or plug-in structure, the angle of inclination of the feeding chute ranges from 30°-70°, preferably from 45°-60°.

Preferably, the portion of the lower part of the funnel withstanding the flow of hot slag is provided with the water-cooling equipment, the feeding chute adopts the outer side water cooling method, with a water jacket or pipe coil structure, cooling of the chute wall surface is achieved by the water cooling mechanism.

According to the present disclosure, the material receiving area on the upper part of the funnel is provided with the speaker structure with arc transition, the chute on the lower part slag receiving area is provided with the water-cooling structure, the cross section of the chute is an ellipse with smooth transition.

'The size of the lower opening end matches with the size of the opening end of the storage bin', for example, the lower opening end of the chute with the funnel is circular, forming the clearance fit with the end of the storage bin.

The method comprises rotary drum processing of steel slag, the rotary drum has a double-walled, multi-chamber structure, provided with a plurality of cooling agent inside such as steel balls and process cooling water, which can perform ball cooling—crushing— water spray cooling—water immersion cooling sequentially on the high temperature steel slag entered therein, the cooled and crushed tailings are led out from the tube in batches with the rotation of the tube and enter the subsequent conveying equipment.

The high efficiency processing plant for multiphase steel slag according to the present disclosure, comprising steel slag feeding equipment—rotary drum for processing steel slag—exhaust emission and purification equipment—cooling water circulation equipment and cold steel cleaning equipment in sequence, wherein the steel slag feeding equipment comprises:

the steel slag feeding equipment comprises the slag tank tilting equipment and the water-cooling type feeding chute provided at the front side, the slag tank tilting equipment can be driven to move forwards and backwards along the horizontal track by the hydraulic mechanism to adjust the horizontal position of the feeding chute from the slag tank mouth;

the slag tank tilting equipment is provided with two tank holding arms that can be driven to rotate 0-180 degrees by hydraulic pressure to hold up and control the slag tank to rotate, pouring out or deducting the slag in the slag tank in a controllable manner;

the storage bin is provided between the cooling type feeding chute and the rotary drum, the storage bin is in a cylindrical or conical shape, one end forms a clearance fit with the lower opening end of the chute with the funnel, the other end is connected with the processing chamber of the rotary drum and coaxial with the rotary drum, the outer wall of the storage bin is provided with the reinforcing plate, the outside of the reinforcing plate is provided with the annular cooling spray tubes along the circumference, the spray tubes are provided evenly along the axis of the storage bin, the outer cover is provided outside the cooling tubes, the outer cover is fixed with the ground and discharges the spraying water collected from the cooling tube, the cooling tube is fixed on the cover.

The processing plant for multiphase steel slag according to the present disclosure, wherein the water-cooling type feeding chute has a large upper portion and a small lower portion, the size and shape of the upper edge matches with the size of the slag tank mouth, and the lower opening end forms a clearance fit with the opening end of the storage bin.

The processing plant for multiphase steel slag according to the present disclosure, wherein the axis of the rotary drum has an angle of inclination relative to the horizontal plane, where the angle of inclination ranges from 0° to 25°, preferably from 5° to 15°.

The processing plant for multiphase steel slag according to the present disclosure, wherein the connecting part of the storage bin and the rotary drum has a flange structure, fixed by bolts and pins.

The processing plant for multiphase steel slag according to the present disclosure, wherein the slag discharging area of an outer cylinder of the rotary drum is provided with the water collecting rooms with a type of waterwheel, ensuring that there is no accumulation of water during processing, the rooms are provided evenly along the circumference of the outer cylinder, the angle of the partition plate between the rooms matches with the opening angle of the slag receiving funnel.

The processing plant for multiphase steel slag according to the present disclosure, wherein the connecting part of the storage bin and the rotary drum has a flange structure, fixed by bolts and pins.

Therefore, it can be fixed securely and convenient for replacement and maintenance.

According to the disclosure, the outer wall of the storage bin is provided with the grid-shaped reinforcing plate to improve the rigidity and strength of the storage bin and also increase the heat dissipation area.

The processing plant for multiphase steel slag according to the present disclosure, the material receiving area on the upper part of the funnel is provided with the speaker structure with arc transition, the chute on the lower part slag receiving area is provided with the water-cooling structure, the cross section of the chute is an ellipse with smooth transition.

The processing plant for multiphase steel slag according to the present disclosure, wherein the angle of inclination of the storage bin to the horizontal plane is 5-15°, preferably 8-12°, and the storage bin is fixed with the rotary drum, the volume of the storage bin is 2-3 times the volume of the slag tank for accommodating all the slag in the slag tank.

According to the disclosure, the steel cleaning machine is further comprised for fast cleaning the large pieces of cold steel from the rotary drum.

The method comprises rotary drum processing of steel slag, the rotary drum has a double-walled, multi-chamber structure, provided with a plurality of cooling agent inside such as steel balls and process cooling water, which can perform ball cooling—crushing—water spray cooling—water immersion cooling sequentially on the high temperature steel slag entered therein, the cooled and crushed tailings are led out from the tube in batches with the rotation of the tube and enter the subsequent conveying equipment.

According to the disclosure, the supporting roller of the rotary drum is provided on the shared base with the positioning function.

According to the disclosure, the cooling water circulation system of the rotary drum is provided with the swirling water well beside the machine, the swirling water well is in a conical shape, provided with the circulating water pump on the upper part and the spiral slag discharging mechanism on the lower part.

According to the disclosure, with the aid of the slag tank tilting mechanism, the safe and environmental friendly rotary drum processing technique for each type of steel slag can be achieved by the storage bin that is inclined and provided between the front of the rotary drum and the feeding chute, working as buffer transition section, without using the slag removal equipment, and the processing efficient is more than double that of the conventional rotary drum. Since the continuous operation of the rotary drum is achieved, the temperature fluctuation of the rotary drum is small, the operating life is long and the maintenance cost is low. At the meantime, since the mechanical cold steel cleaning equipment is provided, the downtime of the rotary drum is further reduced and the operation rate of processing steel slag by the rotary drum method is improved.

BRIEF DESCRIPTIONS OF THE DRAWINGS

FIG. 2-1 is a schematic diagram of the storage bin.

FIG. 2-2 is a view of FIG. 2-1 from the D-direction.

Figure 1:
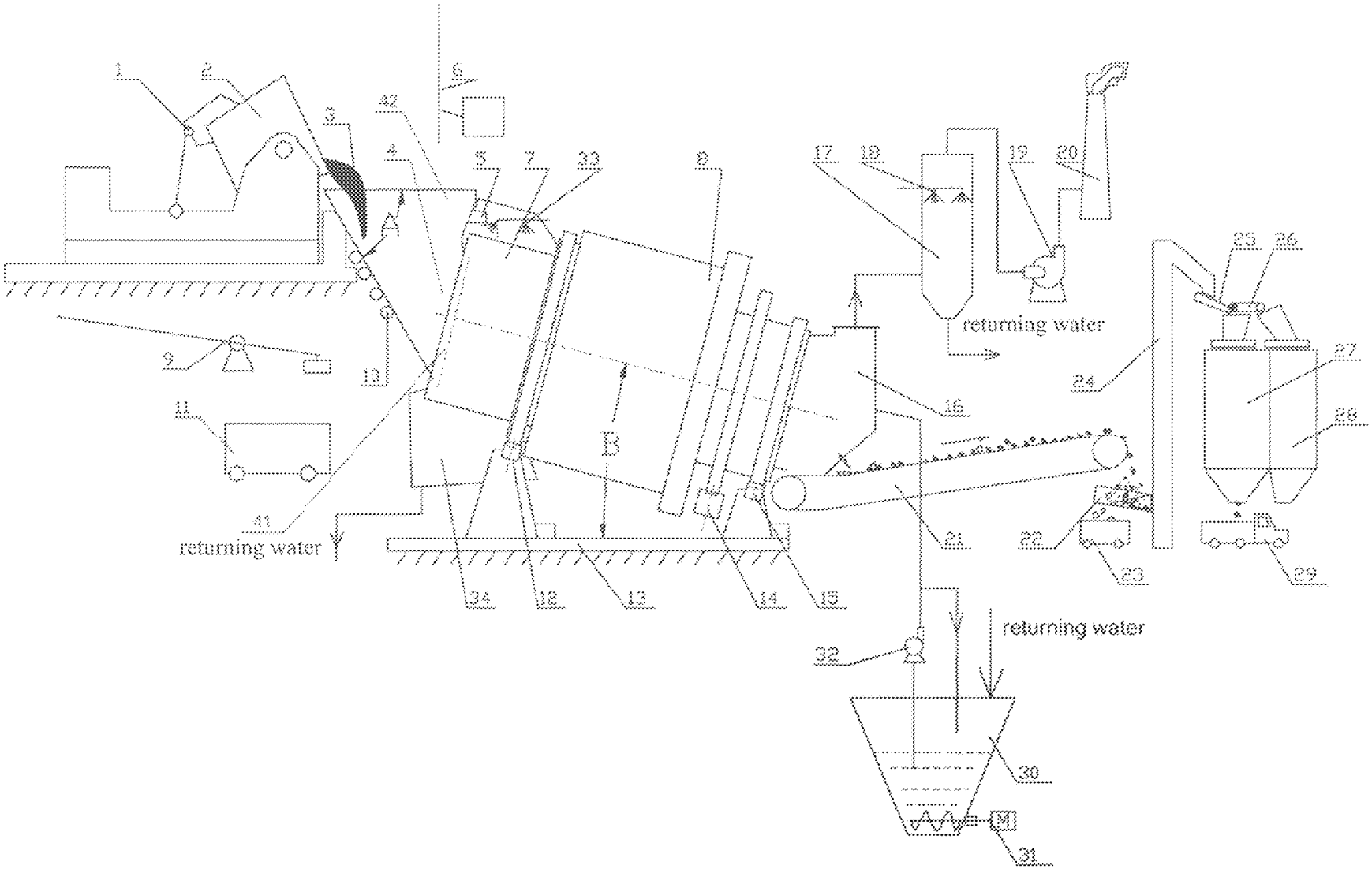
FIG. 1 is a flow diagram of the processing technique by the rotary drum method for full amount steel slag processing according to the disclosure.
Figures 1, 2:
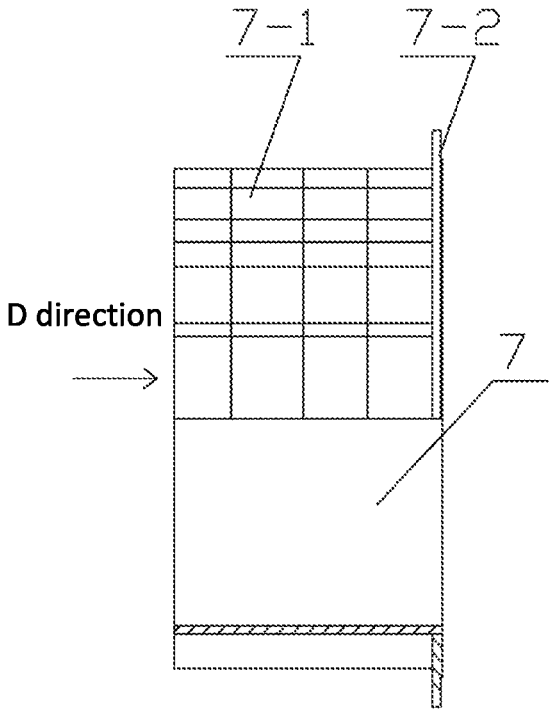
Figure 2:
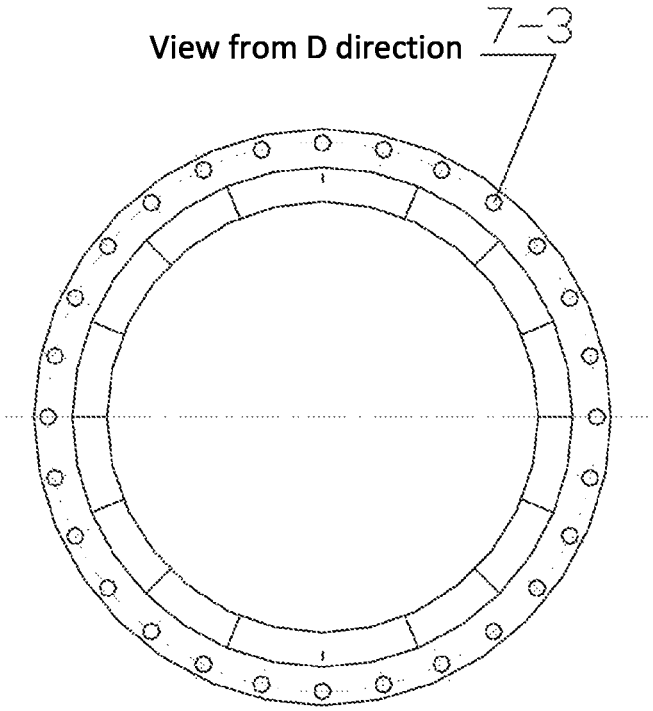
Figure 3:
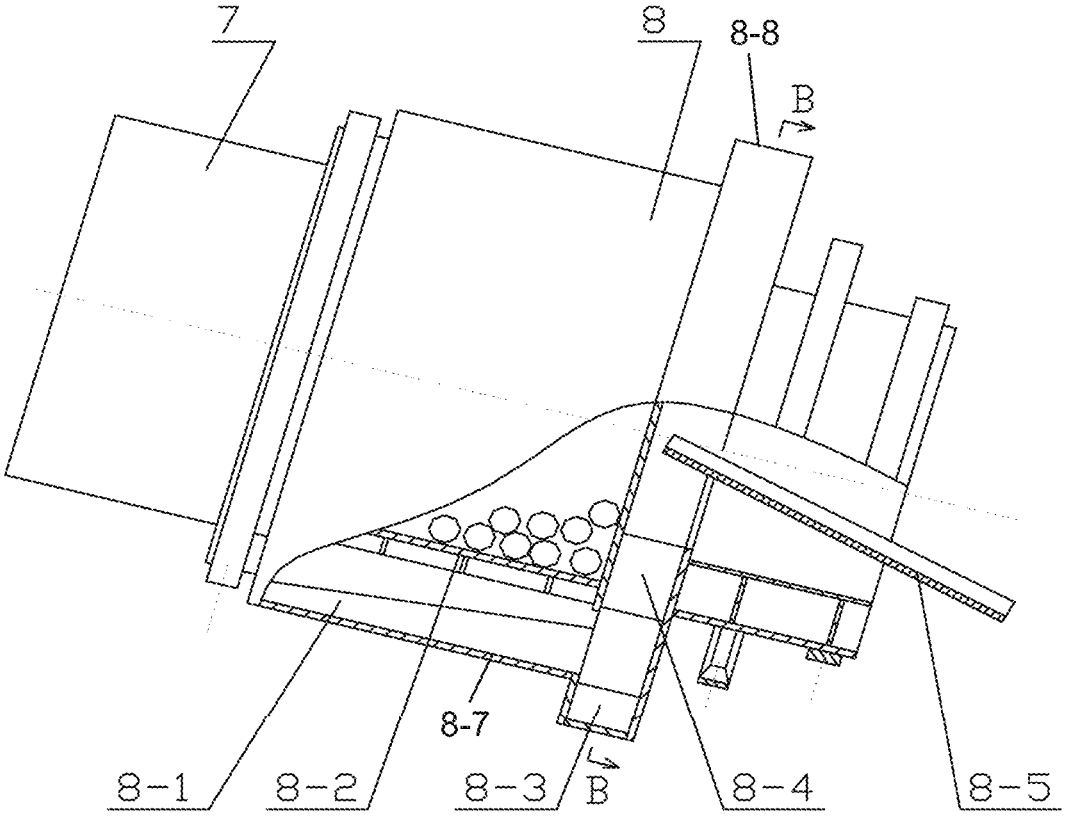
FIG. 3 is a schematic section view of the rotary drum part.
Figure 4:
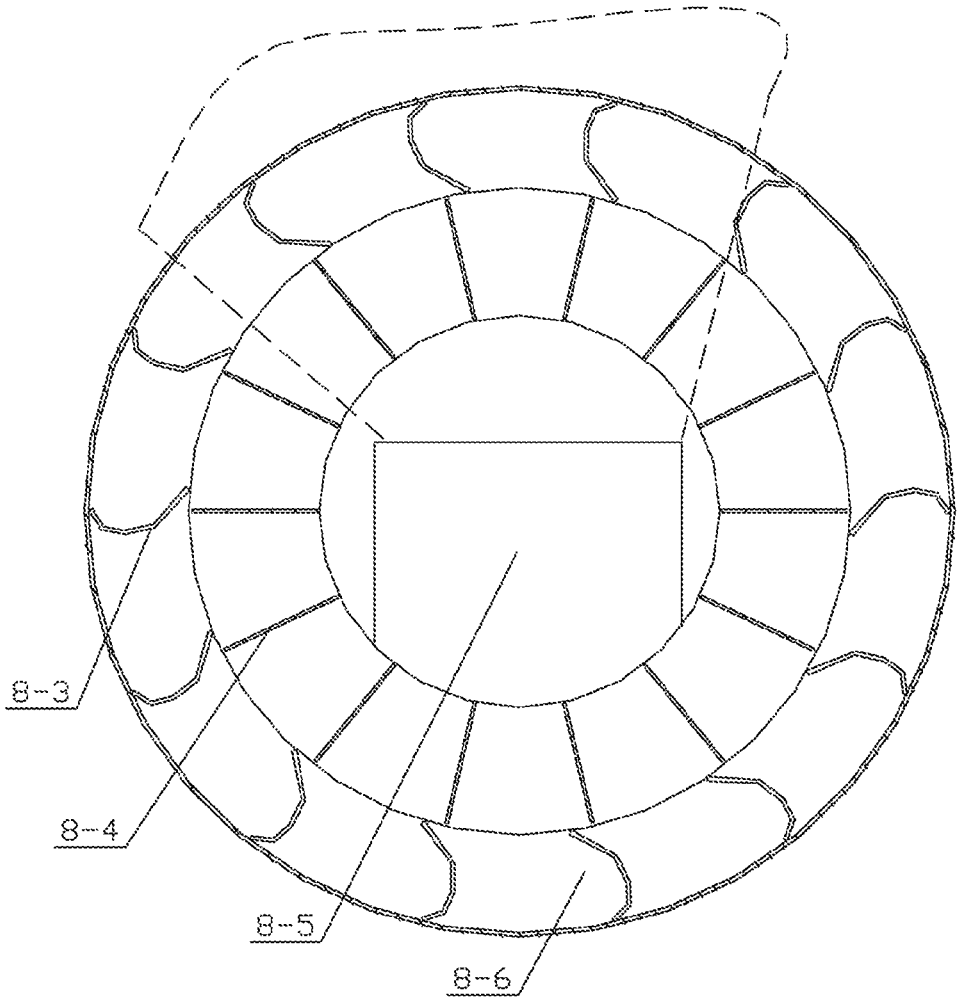
FIG. 4 is a schematic view of FIG. 3 from the B-B direction.

In the Figures: 1 slag tank tilting equipment, 2 slag tank, 3 steel slag (molten slag and solid steel slag), 4 feeding chute, 5 fixing support for the feeding chute, 6 slag cleaning mechanism, 7 storage bin, 7-1 reinforcing equipment, 7-2 connecting flange, 7-3 fastening part. 8 rotary drum, 8-1 grate, 8-2 steel ball, 8-3 partition plate of water collecting rooms with a type of waterwheel, 8-4 supporting plate, 8-5 discharging chute, 8-6 water collecting rooms with a type of waterwheel, 8-7 outer cylinder, 8-8 slag discharging area, 9 steel cleaning machine, 10 water cooling mechanism for the feeding chute, 11 cold steel trolley, 12 front supporting roller equipment, 13 shared base with positioning function, 14 transmission mechanism, 15 rear supporting roller equipment, 16 gas collecting cover, 17 dust removal tower, 18 exhaust gas purification equipment, 19 fan, 20 chimney, 21 combined conveyor, 22 first vibrating screen, 23 slag steel trolley, 24 bucket elevator, 25 second vibrating screen, 26 iron remover, 27 temporary slag bin, 28 temporary slag steel bin, 29 truck, 30 swirling water well beside the machine, 31 spiral slag discharging mechanism, 32 circulating water pump, 33 cooling tubes, 34 outer cover.

DETAILED DESCRIPTIONS

The disclosure is further described below with reference to the drawings and specific embodiments.

A high efficiency processing plant for multiphase steel slag, suitable for full amount steel slag processing by a rotary drum method, comprises a slag tank tilting equipment 1, a feeding chute 4 provided with a funnel 42, a storage bin 7, a cooling system for storage bin, a rotary drum, a slag conveying and storing system, a exhaust emission and purification system, a cooling water circulation system, a slag cleaning mechanism 6 and a cold steel cleaning mechanism, etc., a plurality of systems constitute a complete fully quantified processing technique by the rotary drum method for steel-making slag.

The slag tank tilting equipment 1 is provided above a side of the feeding chute 4 of the rotary drum 8, which can be driven to move forwards and backwards along a horizontal track by a hydraulic mechanism to adjust a horizontal position of the feeding chute 4 from a slag tank mouth; the slag tank tilting equipment 1 is provided with two tank holding arms that are driven to rotate by hydraulic pressure, and can hold up a slag tank 2 and control the slag tank 2 to rotate, the rotation angle is 0-180 degrees, which is convenient to pour out or deduct slag 3 in the slag tank 2 in a controllable manner.

The rotary drum 8 is provided with a gas collecting cover 16, a front supporting roller equipment 12, a rear supporting roller equipment 15, a transmission mechanism 14, a shared base 13 with positioning function and other mechanisms and parts. An axis of the rotary drum 8 has an angle of inclination relative to the horizontal plane, where the angle of inclination ranges from 0° to 25°, preferably from 5° to 15°.

The feeding chute 4 is provided on a steel structure platform 5, which can transmit an impact force of the steel slag to a foundation directly. The feeding chute 4 has a straight-through cavity structure, with a large upper portion and a small lower portion, the size and shape of an upper edge matches with the size of the slag tank mouth, the size of a lower opening end 41 of the feeding chute 4 matches with the size of an opening end of the storage bin 7, forming a loose dynamic fit, as shown in FIG. 1, the lower opening end 41 is inserted into a left end of the storage bin 7 to prevent slag leakage effectively. The feeding chute 4 adopts an outer side water cooling method, with a water jacket or pipe coil structure, and the cooling of a chute wall surface is achieved by a water-cooling mechanism 10. The angle of inclination A to the horizontal of a side wall of the feeding chute 4 ranges from 30°-70°, preferably from 45°-60°.

The storage bin 7 is an open tube in a cylindrical or conical shape, with a single layer or multiple layer structure. One end of the storage bin 7 has a size that matches with the size of the lower opening of the feeding chute 4, forming a loose dynamic fit for receiving the high temperature steel slag conveyed by the feeding chute 4, and the other end is fixed and coaxial with the rotary drum 8 for conveying the high temperature steel slag into a processing chamber of the rotary drum 8 with the rotation of the rotary drum. An inner wall of the storage bin 7 has a smooth cylindrical or conical structure, and the part to be connected with the rotary drum 8 has a flange structure, fixed by bolts and pins, which is secure and convenient for replacement and maintenance; an outer wall of the storage bin 7 is provided with a grid-shaped reinforcing plate to improve the rigidity and strength of the storage bin and also increase the heat dissipation area.

The rotary drum 8 has a double-walled, multi-chamber structure, provided with a plurality of cooling agent such as steel balls and process cooling water, which can perform ball cooling—crushing— water spray cooling—water immersion cooling sequentially on the high temperature steel slag entered therein, the cooled and crushed tailings are led out from the tube in batches with the rotation of the tube and enter the subsequent conveying equipment.

The front supporting roller equipment 12 comprises two sets of roller and roller stand, forming into a V-shape to engage with a front-end supporting ring of the rotary drum 8; the rear supporting roller equipment 15 comprises two sets of roller and roller stand, forming into a V-shape to engage with a rear end supporting ring of the rotary drum 8. The front supporting roller equipment 12 and the rear supporting roller equipment 15 work together to supporting the rotary drum 8 and the storage bin 7 to rotate flexibly along an axis. The front supporting roller equipment 12 and the rear supporting roller equipment 15 are provided on the shared base 13, which are fixed by a positioning equipment and can be adjusted according to the actual needs to ensure that the angle B of the axis of the tube is correct and each set of rollers can engage with the corresponding supporting ring tightly.

The shared base 13 with positioning function is an integral steel structure platform with a certain rigidity and strength to ensure that the front supporting roller equipment 12 and the rear supporting roller equipment 15 are in the same plane and the supporting surface would not be tilted due to foundation settlement. The shared base 13 is provided with the positioning equipment for supporting the roller equipment, which can adjust the front supporting roller equipment 12 and the rear supporting roller equipment 15 conveniently, facilitating the positioning process.

The transmission mechanism 14 comprises a driving motor, a shaft coupling, a reducer, a universal shaft, a pinion shaft, a large ring gear and a base, the pinion shaft is suspended flexible on the large ring gear of the rotary drum by a towing mechanism, and the flexible transmission of the rotary drum is achieved by the universal shaft and the suspension mechanism of the pinion shaft to ensure that the pinion shaft can engage with the large ring gear tightly and the damage on the tooth surface caused by the vibration of the rotary drum can be avoided.

The slag conveying and storing system comprises a combined conveyor 21, a first vibrating screen 22, a slag steel trolley 23, a bucket elevator 24, a second vibrating screen 25, an iron remover 26, a temporary slag bin 27, a temporary slag steel bin 28, a transport truck 29, etc. The combined conveyor 21 comprises an apron conveyor and a scraper conveyor, where the upper apron conveyor is responsible for conveying most of the granular slag and the lower scraper conveyor is responsible for conveying the fine granular slag that falls from the gap of the apron conveyor, the two conveyors are fixed together and sealed in a casing, which is simple and clean. The first vibrating screen 22 not only can separate the large particle slag steel and transport it away by the slag steel trolley 23, improving the efficiency of resource utilization and preventing the large particle slag steel from impacting and jamming on the subsequent equipment, but also can convey the slag after preliminary screening into the bucket elevator 24 in a relatively even way. The second vibrating screen 25 and the iron remover 26 is responsible for screening the slag steel and separating iron from the slag, the steel slag is magnetically separated and screened online and conveyed into the corresponding temporary slag bin 27 and temporary slag steel bin 28 respectively. The product tailings in the temporary slag bin 27 and the slag steel in the temporary slag steel bin 28 are discharged regularly and delivered to the user by the transport truck 29 directly to achieve the environmentally friendly and resource-efficient processing where the slag does not fall to the ground.

The exhaust emission and purification system comprise a gas collection hood 16, a dust removal tower 17, an exhaust gas purification equipment 18, a fan 19 and a chimney 20. The gas collection hood 16 is provided at the rear of the rotary drum 8 for collecting the exhaust gas containing dust and water vapor generated during the process of processing the high-temperature steel slag by the rotary drum; the dust removal tower 17 and the exhaust gas purification equipment 18 are responsible for the dust removal purification and whitening treatment of the exhaust gas, the exhaust gas after the purification processing is sucked and pressurized by the fan 19 and discharged from the chimney 20 up to the standard.

The cooling water circulation system comprises a swirling water well 30 beside the machine, a spiral slag discharging mechanism 31, a circulating water pump 32 and the corresponding pipes, display instruments and flow control valves. The swirling water well 30 is in a conical shape, provided with the circulating water pump 32 on the upper part and the spiral slag discharging mechanism 31 on the lower part. All the sewage overflowing from the rotary drum 8 and the exhaust gas purification equipment 18 flows into the swirling water well 30. After simple precipitation and purification, the sewage is pumped into the rotary drum 8 and the exhaust gas purification equipment 18 again by the circulating water pump 32 for recycling. The circulating water pump 32 not only is responsible for the water supply of the rotary drum 8 and the exhaust gas purification equipment 18, but also provides part of the circulating water for swirling agitation of the swirling water well, preventing the precipitation and scaling of the slag on the well wall. The slag that sinks to the bottom of the swirling water well 30 is discharged continuously by the spiral slag discharging mechanism 31 provided on the well bottom, achieving the balance of the slag in the circulating water system. The evaporated cooling water is supplied from the pipeline and enters the cooling water circulation system of the equipment from the exhaust gas purification equipment 18, achieving the balance of water.

The slag cleaning machine 6 comprises a slag cleaning head, a slag cleaning rod and a hydraulic drive mechanism. The slag cleaning head is in a conical shape, and its end is connected with the slag cleaning rod by a flange, thread or bayonet connection, which is convenient for replacement; the slag cleaning rod can be driven by the hydraulic drive mechanism to extend upwards and downwards, swing forwards and backwards and move leftwards and rightwards flexibly so as to clean the side wall of the feeding chute 4.

The cold steel cleaning mechanism comprises a hydraulically controlled steel cleaning machine 9 and a cold steel trolley 11 for carrying cold steel, the cold steel cleaning machine comprises a telescopic arm, a base, an electromagnet and a corresponding electric control system. The telescopic arm is provided on the base, and the telescopic arm can be driven by the hydraulic control system to extend upwards and downwards, swing forwards and backwards and move leftwards and rightwards, and the electromagnet at the end portion is driven to transport the large cold steel in the rotary drum into the cold steel trolley 11, realizing the function of mechanically cleaning the cold steel in the rotary drum with remote control.

EMBODIMENT 1

In a 300-ton converter steelmaking process of a steel plant in Baosteel, the slag splashing for furnace protection method is used after tapping for extending the service life of the furnace lining, with a low slag discharge temperature and poor fluidity, or even without fluidity. Each furnace discharges about 30 tons of slag, and the molten slag is conveyed by a 33 $m^3$ slag tank.

With the high efficiency processing plant for multiphase steel slag, when the slag tank 2 is transported to the slag processing room, the slag tank 2 is lifted to the tilting mechanism 1 by the crane, the slag tank 2 is held tightly by the tilting mechanism and fixed on the tilting platform, moving forwards and backwards to an appropriate position and ready to perform slag receiving by tilting the slag tank.

The slag tank 2 is tilted slowly by the slag tank tilting mechanism 1, part of the steel slag with fluidity is poured into the storage bin 7 that works as a buffer transition section through the feeding chute 4, and the steel slag flows into the rotary drum 8 through the storage bin 7 with the rotation of the rotary drum.

The angle of inclination of the storage bin to the horizontal plane is 0-25°, preferably 8-12°, and the storage bin is fixed with the rotary drum, the volume of the storage bin is 2-3 times the volume of the slag tank for accommodating all the slag in the slag tank, preventing the high temperature steel slag from accumulating on the processing chamber and the steel balls which will cause explosion. The steel slag in the storage bin flows into the rotary drum slowly with the rotation of the rotary drum, contacting with the steel balls slowly and being taken away by the steel balls and then cooled and crushed.

Continue to tilt the slag tank 2 so that the angle of inclination of the slag tank gradually increases to more than 150°, at this time, the steel slag without fluidity (highly viscous slag and slag at the bottom of the tank) that remains in the slag tank will fall off from the slag tank piece by piece or even as a whole into the feeding chute 4, and then enters the storage bin 7 without using a slag removal equipment. After the slag in the slag tank has been poured out, the slag tank tilting mechanism 1 returns to its initial position, the slag tank returns to the horizontal free state with the tank mouth facing upwards and is lifted by the crane to enter the recirculating state of receiving slag. A relatively large impact force will be exerted on the feeding chute 4 at the moment of receiving the slag poured out from the tank, and this impact force will be unloaded directly to the foundation by a fixing support 5 for supporting the feeding chute 4.

The steel slag poured into the storage bin 7 (a small amount of which may be located at the lower part of the feeding chute 4) slides and moves downwards continuously due to the rotation of the rotary drum and the gravitational force, and enters the rotary drum 8 in turn for rapid cooling, crushing, and being sprayed and soaked by cooling water, and then the steel slag is discharged from the tube in the form of slag at low temperature (lower than 100° C.) that meets the requirements.

The slag discharged from the rotary drum 8 is lifted to the first vibrating screen 22 by the combined conveyor 21, the slag steel with a relatively large particle size (such as greater than 50 mm) is screened out and conveyed to the slag steel trolley 23 below, and the rest of the steel slag is conveyed evenly to the bucket of the bucket elevator 24. The grade (metal purity) of the part of slag steel screened by the first vibrating screen 22 is above 90%, accounting for about 3% of the total steel slag, which can be returned directly to the steelmaking process for reuse.

The steel slag lifted by the bucket elevator 24 enters the screen of the second vibrating screen 25, and is subjected to magnetic separation processing by the iron remover 26 provided thereon, the steel particle and a small amount of magnetic slag in the steel slag are separated and conveyed to the temporary slag steel bin 28 below, and the rest of the steel slag is conveyed to the corresponding temporary slag bin 27 after being screened by the second vibrating screen 25. The materials in the temporary slag steel bin 28 and the temporary slag bin 27 are transported regularly to the user by the truck 29, achieving the resource utilization of the steel slag.

10-15 minutes after tilting the tank, all the steel slag in the rotary drum is processed and enters the temporary bins through the subsequent equipment, a tank of steel-making steel slag is completely processed by a single rotary drum. The rotary drum starts to process the next tank of steel slag, repeating the above process.

When cleaning the cold steel in the rotary drum, the operation of the rotary drum 8 is stopped to take out the feeding chute 4, the steel cleaning machine 9 is controlled by a remote control, the electromagnet is inserted into the rotary drum 8 from the cavity of the storage bin 7 by the telescopic arm to transport the large pieces of cold steel into the cold steel trolley 11 one by one. After the cold steel on the surface of the steel balls has been cleaned, the telescopic arm of the steel cleaning machine exits, the rotary drum rotates for 3-5 circles at low speed so that the large pieces of cold steel in the steel balls are exposed, and the operation of the steel cleaning machine 9 is continued to clean out these large pieces of cold steel. After repeated for several times, basically all the large pieces of cold steel in the rotary drum 8 can be cleaned out. Using this method, 15 tons of large pieces of cold steel can be cleaned out within 2 hours, and the grade of the cold steel is above 95%, which can be returned directly to the converter for reuse.

The processing technique and processing equipment of steel slag processing by the rotary drum method of the present disclosure comprises a auxiliary feeding system for the steelmaking steel slag processing by the rotary drum method, a rotary drum body technique structure, a finished product slag conveying and storage system, an exhaust gas purification and discharge system, a water circulation system and a mechanically cleaning system for the large pieces of cold steel, constituting a complete processing technique of the steelmaking steel slag (comprising steel slag with good fluidity and solid steel slag without fluidity, such as the steel slag at the bottom of the tank) by the rotary drum method, where the plurality of systems work together to achieve controllable slag feeding of the fully quantified steelmaking steel slag, safe granulation of rotary drum, slag transportation and storage of slag without landing, exhaust gas discharge up to standard, sewage recycling and mechanical cleaning of the large pieces of cold steel. Starting from tilting the high temperature steel slag into the rotary drum, separating the steel until the slag at room temperature is temporarily stored in the storage bin, the entire processing cycle does not exceed 5 minutes, the slag steel and final product can be separated and selected online and transported directly to the user for resource utilization, with exhaust gas discharge up to standard, cooling water recycling and zero discharge, which can truly realize the fully quantified, short-process, safe, environmental friendly and recycling processing of steelmaking molten slag.

According to the disclosure, the processing method and processing equipment can achieve the goal of fully quantified, continuous, high-efficiency and automated steel slag processing, where the high temperature molten slag with high fluidity can be processed, and the highly viscous slag sticked on the slag tank wall and the solid slag without fluidity, specially the large-sized slag on the bottom of the tank, can also be processed, and the requirement of automated operation can be satisfied as well, reducing potential safety hazards and errors caused by manual operation.

According to the disclosure, with the aid of the slag tank tilting mechanism, the safe and environmental friendly rotary drum processing technique for each type of steel slag can be achieved by the storage bin that is inclined and provided between the front of the rotary drum and the feeding chute 4, working as buffer transition section, without using the slag removal equipment, and the processing efficient is more than double that of the conventional rotary drum. Since the continuous operation of the rotary drum is achieved, the temperature fluctuation of the rotary drum is small, the operating life is long, and the maintenance cost is low. At the meantime, since the mechanical cold steel cleaning equipment is provided, the downtime of the rotary drum is further reduced and the operation rate of processing steel slag by the rotary drum method is improved.

The invention claimed is:

1. A processing plant for multiphase steel slag, comprising a steel slag feeding equipment and a rotary drum for processing steel slag, wherein the steel slag feeding equipment comprises a feeding chute;

the processing plant for multiphase steel slag further comprises a storage bin is provided between the feeding chute and the rotary drum, the storage bin is with a shape of barrel, with one end forming a rotatable fit with a lower opening end of the chute with a funnel, the other end being connected with a processing chamber of the rotary drum and coaxial with the rotary drum;

a slag discharging area of an outer cylinder of a rotary drum is provided with water collecting rooms configured as a waterwheel to ensure no accumulation of water during processing, and the rooms are provided evenly along the circumference of the outer cylinder, an angle of a partition plate between two adjacent water collecting rooms matches with an opening angle of the funnel for receiving slag.

2. The processing plant for multiphase steel slag according to claim 1, wherein the lower opening end of the chute forms a clearance fit with an opening end of the storage bin.

3. The processing plant for multiphase steel slag according to claim 1, wherein an axis of the rotary drum has an angle of inclination relative to a horizontal plane, where the angle of inclination ranges from 0° to 25°.

4. The processing plant for multiphase steel slag according to claim 1, wherein an axis of the rotary drum has an angle of inclination relative to a horizontal plane, where the angle of inclination ranges from 8° to 12°.

5. The processing plant for multiphase steel slag according to claim 1, wherein the inner wall of the storage bin is water cooling wall.

6. The processing plant for multiphase steel slag according to claim 1, wherein annular cooling spray tubes are provided, the spray tubes are provided evenly along an axis of the storage bin, an outer cover is provided outside the cooling tubes, the outer cover is fixed with ground and discharges spraying water collected from the cooling tubes, the cooling tubes are fixed on the cover.

7. The processing plant for multiphase steel slag according to claim 1, wherein a lower portion of the feeding chute withstanding flow of hot slag is provided with a water cooling equipment.

8. The processing plant for multiphase steel slag according to claim 1, wherein a volume of the storage bin is 2-3 times a volume of a slag tank.

9. The processing plant for multiphase steel slag according to claim 1, wherein the lower opening end of the feeding chute is inserted into the end of the storage bin.

* * * * *